United States Patent [19]

Yamaguchi et al.

[11] Patent Number: 4,773,949

[45] Date of Patent: Sep. 27, 1988

[54] PROCESS FOR PREVENTING TRANSVERSE DISPLACEMENT OF METAL STRIP

[75] Inventors: Yasuhiro Yamaguchi; Isamu Shioda; Yuji Shimoyama; Hisao Yasunaga; Yukio Ida, all of Chiba, Japan

[73] Assignee: Kawasaki Steel Corporation, Kobe, Japan

[21] Appl. No.: 17,872

[22] Filed: Feb. 24, 1987

[30] Foreign Application Priority Data

Sep. 9, 1986 [JP] Japan ..... 61-211910

[51] Int. Cl.[4] ..... C21D 9/56

[52] U.S. Cl. ..... 148/128; 148/130; 148/156

[58] Field of Search ..... 148/128, 153, 155, 156, 148/12 D, 130, 131

[56] References Cited

U.S. PATENT DOCUMENTS

| | | | |
|---|---|---|---|
| 2,783,788 | 3/1957 | Ungerer | 266/103 |
| 4,363,471 | 12/1982 | Yanagishima | 266/111 |
| 4,571,274 | 2/1986 | Yanagishima | 148/156 |

*Primary Examiner*—Christopher W. Brody

*Attorney, Agent, or Firm*—Balogh, Osann, Kramer, Dvorak, Genova & Traub

[57] ABSTRACT

A process for preventing transverse displacement of metal strip comprises correcting a shape of metal strip into flat form prior to the travel of the metal strip into a continuous annealing furnace when continuously annealing the metal strip in the furnace under a condition of LSD≧100 (representing a product of line speed and strip gauge).

2 Claims, 4 Drawing Sheets

PROCESS FOR PREVENTING TRANSVERSE DISPLACEMENT OF METAL STRIP

CROSS REFERENCE TO RELATED APPLICATIONS

This application is related to application Ser. Nos. 629,950 and 944,673.

BACKGROUND OF THE INVENTION

1. Field of the Invention

This invention relates to a process for preventing transverse displacement of metal strip when treating a metal strip such as blackplate, steel sheet fo automobiles, stainless steel sheet or the like in a continuous annealing furnace, which can perform stable operation by correcting the strip into a flat state under given conditions prior to the travel of the strip into the furnace.

2. Related Art Statement

In general, many hearth rolls for travelling the metal strip are used in the continuous heat-treating furnace for the metal strip. For instance, many hearth rolls 6 are arranged in each of a heating zone 2, a soaking zone 3, a slow cooling zone 4, a quenching zone 5 and the like constituting a continuous annealing furnace as shown in FIG. 2. A metal strip 1 is successively travelled over these hearth rolls 6 in a direction of from arrow A to arrow B in the continuous annealing furnace, during which the strip is subjected to a given heat treatment.

In the first half of the heating zone 2, since the hearth roll 6 comes into contact with the low temperature metal strip 1, it has a temperature distribution as shown by a solid line in FIG. 3. As the strip travelling speed or line speed becomes faster, the surface temperature of the hearth roll 6 further drops and the temperature distribution becomes large concave as shown by dotted lines in FIG. 3, and consequently the net crown quantity of the hearth roll 6 decreases. Therefore, when the metal strip 1, a shape of which being not flat but stretched state at an edge or central portion, is travelled on the hearth roll 6 having such a concave profile, the tension in widthwise direction of the strip is immediately unbalanced to cause a large transverse displacement of metal strip. In order to prevent such a transverse displacement, it is necessary to make the difference of temperature between the edge portion and the central portion of the hearth roll small, so that it is obliged to decelerate the line speed, resulting in the decrease of operation efficiency. On the other hand, the similar phenomenon occurs even when the strip gauge becomes large at the same line speed. When the initial crown quantity of the hearth roll is previously made large as a countermeasure, if the line speed decreases, the net crown quantity in the heating zone 2 becomes excessive to cause heat buckle. In FIG. 4 is shown a relation between the roll temperature and the line speed.

That is, since both end portions of the hearth roll do not come into contact with the metal strip, the roll temperature of these portions is governed by radiation heat of the furnace and is substantially unchangeable even when the line speed is varied. While, in the central portion of the hearth roll contacting with the metal strip, heat is transferred from this central portion to the metal strip because the strip temperature is low, so that the roll temperature in the central portion becomes lower as compared with the roll temperature in the both end portions. This phenomenon becomes conspicuous as the line speed increases. Therefore, in case of the low line speed, the difference in roll temperature between the central portion and the end portion is small and the crown quantity of the roll is enough to correct the transverse displacement of the metal strip, while when the difference in roll temperature is large, the crown quantity of the roll is too small and the ability of correcting the transverse displacement is substantially lost. In the latter case, if the shape of the metal strip is bad, the strip is largely displaced in the transverse direction.

Under the above circumstances, there have been proposed many attempts for stabilizing the operation by controlling the crown quantity of the hearth roll 6. For example, Japanese Patent laid open No. 57-177,930 and Japanese Utility Model laid open No. 58-105,464 disclose that the thermal crown quantity of the hearth roll is controlled by heating and cooling the roll, and Japanese Utility Model laid open No. 55-172,359 discloses that the crown quantity is adjusted by the arrangement of a bending apparatus.

However, when the techniques disclosed in these articles are applied to an actual operation, it is required to arrange the devices for measuring and controlling the crown quantity every hearth roll, which raises many problems in view of cost and the like.

SUMMARY OF THE INVENTION

It is, therefore, an object of the invention to solve the aforementioned problems of the conventional technique by flattening the shape of the metal strip under given conditions prior to the travel of the strip into the furnace.

According to the invention, there is the provision of a process for preventing transverse displacement of a metal strip when continuously annealing the metal strip in a continuous annealing furnace under a condition of $LSD \geqq 100$, wherein LSD is a product of line speed (m/min) and strip gauge (mm), which comprises correcting a shape of the metal strip into flat form prior to the travel of the metal strip into the furnace.

In a preferred embodiment of the invention, the correction of the metal strip is carried out so that a relation between LSD and steepness $\lambda$ of strip satisfies $\lambda \leqq 288/LSD$.

BRIEF DESCRIPTION OF THE DRAWINGS

The invention will be described with reference to the accompanying drawings, wherein.

DESCRIPTION OF THE PREFERRED EMBODIMENTS

When a product of line speed (m/min) and strip gauge (mm) is expressed by LSD (which means a heating capacity) in the continuous annealing of metal strip, if the value of LSD exceeds 100, the metal strip begins to cause the transverse displacement. According to the invention, the continuous annealing operation at LSD of more than 100 can efficiently be performed by previously flattening the shape of the metal strip before the travelling into the continuous annealing furnace.

The flattening of the metal strip is sufficiently achieved by making the steepness λ of the strip small. In this connection, it is most economy and efficient to select the steepness λ corresponding to the line speed within a range of causing no transverse displacement of the strip. According to the invention, the high efficiency operation as mentioned above can be made by correcting the shape of the metal strip so as to satisfy $\lambda \leqq 288/LSD$ as a relation between LSD and steepness λ.

Figure 1:
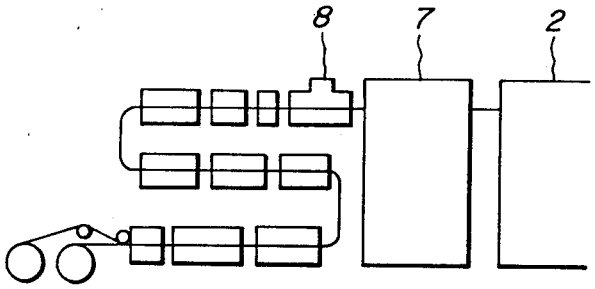
FIG. 1 is a schematic view of an embodiment of the apparatus for practising the process according to the invention.
Figure 2:
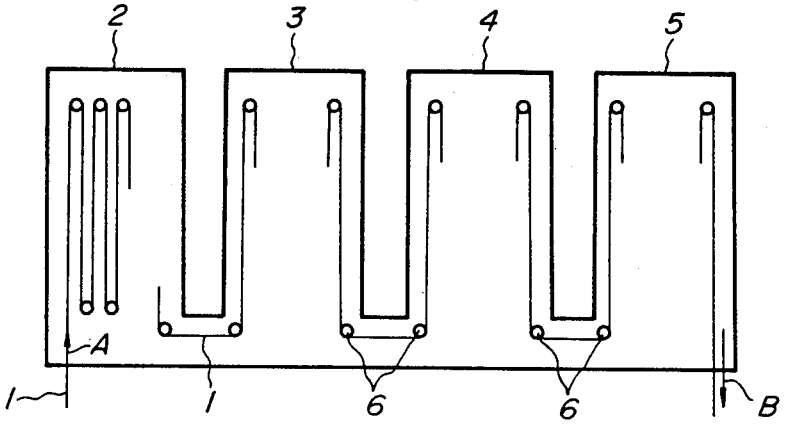
FIG. 2 is a schematic view of a continuous annealing furnace.
Figure 3:
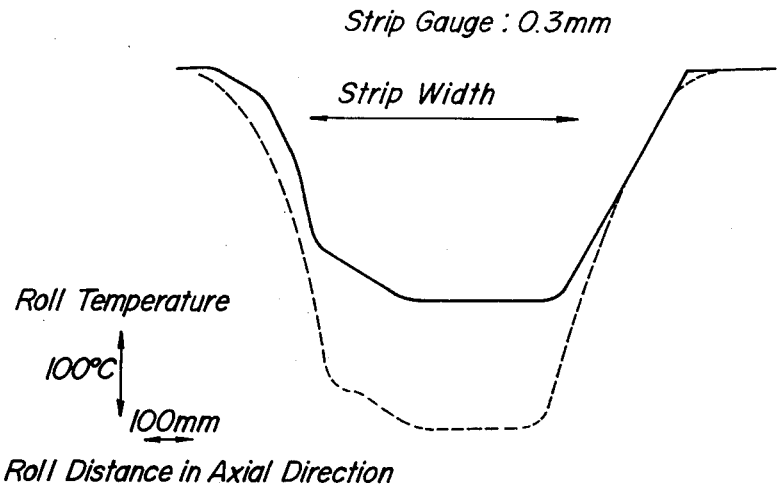
FIG. 3 is a diagram showing a temperature distribution of a hearth roll.
Figure 4:
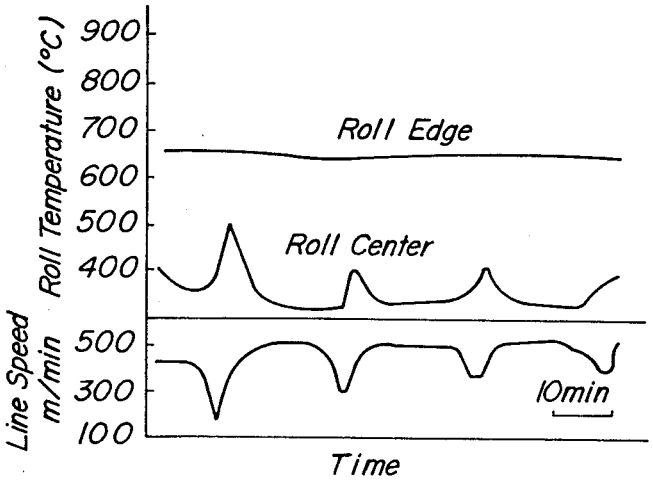
FIG. 4 is a graph showing a relation of a line speed to temperatures at central and both end portions of a hearth roll.

FIG. 1 shows a first embodiment of the invention, and FIGS. 5–8 show data proving the effectiveness of the invention.

In FIG. 1, numeral 7 is an entry looper arranged at an entry side of a heating zone 2 in a continuous annealing furnace, and numeral 8 is a tension leveler arranged at the entry side of the entry looper 7. The latter is a means for correcting the shape of the metal strip by making the unevenness of the strip as small as possible to maintain the line speed at a high value while preventing the transverse displacement of the strip. Further, as is well-known, bridle rolls (not shown) are arranged at the entry side and exit side of the leveler 8, respectively, to apply a large tension to the strip, and a small-size roll is pushed down to the strip for repeating the bending and stretching of the strip, whereby the strip is further flattened.

Figure 5:
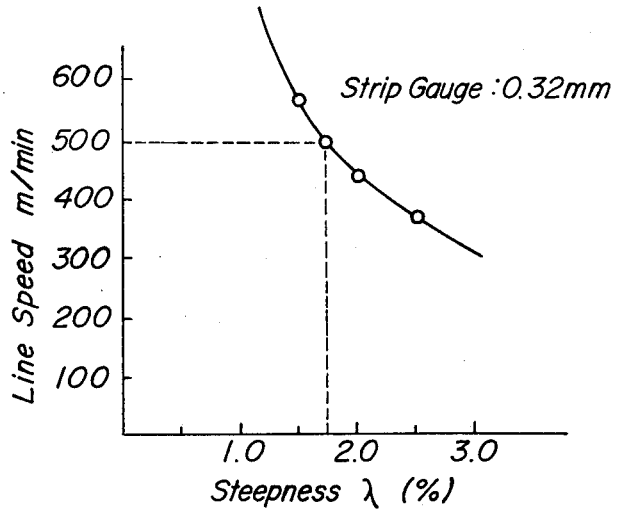
FIG. 5 is a graph showing a relation between steepness and line speed.
Figure 6:
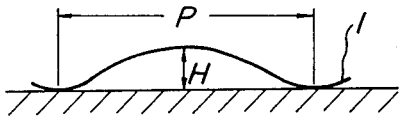
FIG. 6 is a diagram for defining a steepness.

A relation between the degree of flattening the metal strip and the line speed is shown in FIG. 5, wherein an abscissa is a steepness (λ, %) represented by a ratio of height of convex portion H to distance between adjoining concave portions P when the metal strip 1 is rugged as shown in FIG. 6. Particularly, FIG. 5 shows results examined on the relation between steepness λ causing no transverse displacement and line speed when continuously annealing a blackplate of 0.32 mm in gauge. As seen from FIG. 5, the continuous annealing treatment can be performed in a lower region of the curved line without causing transverse displacement. For instance, when the steepness λ is 1.75%, the line speed can be raised to 500 m/min, while when the steepness λ is 1.0%, even if the annealing is performed at a high line speed of more than 600 m/min, the transverse displacement is never caused.

Figure 7:
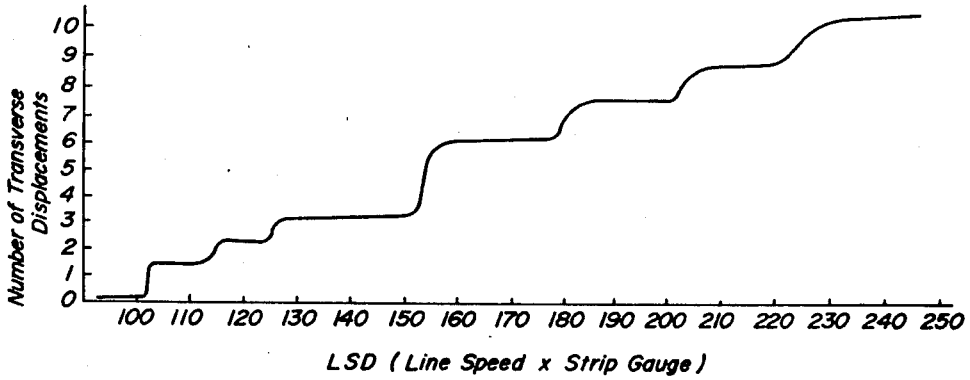
FIG. 7 is a graph showing a relation of LSD to number of transverse displacements generated per coil.

In the continuous annealing of the metal strip, when the product of line speed (m/min)×strip gauge (mm) is represented by LSD, if the value of LSD exceeds 100, the transverse displacement of the metal strip rapidly increases as shown in FIG. 7. The number of transverse displacements means the transverse displacement number generated when continuously annealing a coil of metal strip, i.e. number of counting a case that the strip displaces from the central portion of the hearth roll toward one end thereof up to a distance of 30 mm measured from the end of the hearth roll to decelerate the line speed. The number of transverse displacements in FIG. 7 is an average value of 20 coils. In order to permit the high efficiency operation at LSD of more than 100 (or maximum heating capacity ton/hour), therefore, it is necessary that the shape of the metal strip is previously flattened prior to the travel into the continuous annealing furnace. Such a flattening of the metal strip is achieved by making the steepness of the metal strip small, so that it is most economy and efficient to select the steepness λ in accordance with the given line speed within a range causing no transverse displacement of the metal strip.

Figure 8:
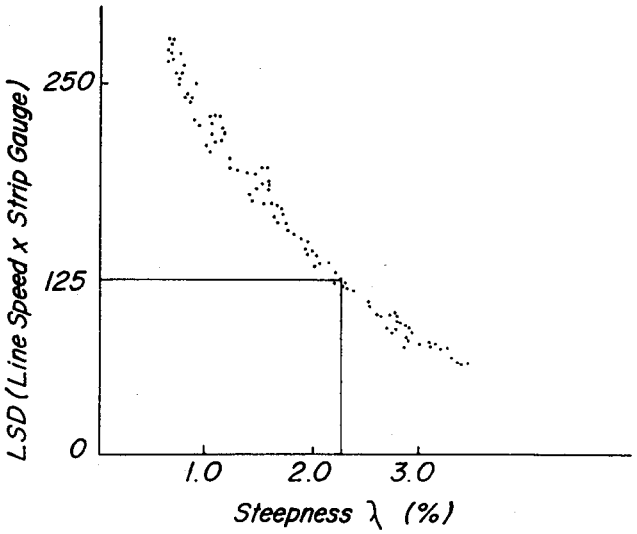
FIG. 8 is a graph showing a relation between steepness and LSD.

The relation between LSD causing no transverse displacement and steepness λ was examined by varying the line speed LS, strip gauge D and steepness λ to obtain results as shown in FIG. 8, from which it has been found that the above relation can be represented by $\lambda \leqq 288/LSD$. That is, when the shape of the metal strip is so corrected that the relation between LSD and λ satisfies the above relationship formula, the required maximum heating capacity can be obtained without causing transverse displacement.

As mentioned above, according to the invention, when continuously annealing the metal strip at $LSD \geqq 100$, the transverse displacement of the strip is prevented by flattening the strip prior to the travel into the furnace so as to satisfy $\lambda \leqq 288/LSD$, so that the stable operation can be made without transverse displacement even when the strip is travelled through the continuous annealing furnace at a required high line speed. Consequently, according to the invention, the production efficiency can largely be increased without lowering the yield.

What is claimed is:

1. A process for preventing transverse displacement of a metal strip when continuously annealing the metal strip in a continuous annealing furnace provided at each of the entry and exit sides with a looper under a condition of $LSD \geqq 100$, wherein LSD is a product of line speed (m/min) and strip gauge (mm), which comprises correcting a shape of the strip into flat form on the entry side of the entry looper prior to the travel of the strip into the furnace.

2. The process according to claim 1, wherein the correction of said metal strip is carried out so that a relation between LSD and steepness λ of strip satisfies $\lambda \leqq 288/LSD$.

* * * * *